United States Patent [19]

Granskog

[11] Patent Number: 4,960,175

[45] Date of Patent: Oct. 2, 1990

[54] EQUIPMENT FOR RAISE MINING

[75] Inventor: Roland Granskog, Skelleftea, Sweden

[73] Assignee: Alimak AB, Skelleftea, Sweden

[21] Appl. No.: 401,441

[22] PCT Filed: Feb. 19, 1988

[86] PCT No.: PCT/SE88/00074

§ 371 Date: Sep. 12, 1989

§ 102(e) Date: Sep. 12, 1989

[87] PCT Pub. No.: WO88/07123

PCT Pub. Date: Sep. 22, 1988

[30] Foreign Application Priority Data

Mar. 20, 1987 [SE] Sweden ..... 8701161
Dec. 9, 1987 [SE] Sweden ..... 8704911

[51] Int. Cl.[5] ..... E21B 41/00
[52] U.S. Cl. ..... 175/86; 175/53
[58] Field of Search ..... 175/53, 86, 97, 98, 175/99; 405/133, 148

[56] References Cited

U.S. PATENT DOCUMENTS 4,527,640 7/1985 Sainio ..... 175/86

FOREIGN PATENT DOCUMENTS 1183556 3/1985 Canada ..... 175/53
8902025 3/1989 European Pat. Off. ..... 175/86
0881330 11/1981 U.S.S.R. ..... 175/53
0979639 12/1982 U.S.S.R. ..... 175/86
1164424 6/1985 U.S.S.R. ..... 175/53

*Primary Examiner*—William P. Neuder
*Attorney, Agent, or Firm*—Townsend and Townsend

[57] ABSTRACT

An assembly for raise mining or the like includes a drive support carrying a drive means (10) for driving the drive support along a guide (4). The guide is attached to the drift wall (2) and is successively lengthened concurrently with the drift driving. The drive support carries at least one drill boom rig (62) for mechanized drilling, and an operator's and service platform (40). The operator's and service platform (40) is carried shiftable with respect to the drive support in the direction of the guide (4) between a lower position, in which it does not obstruct the working movements of the drill boom rig (62), and upper positions, in which the drill boom assembly (62) in a collapsed non-operative position extends through an opening in the operator's and service platform (40).

15 Claims, 4 Drawing Sheets

EQUIPMENT FOR RAISE MINING

Figure 1:
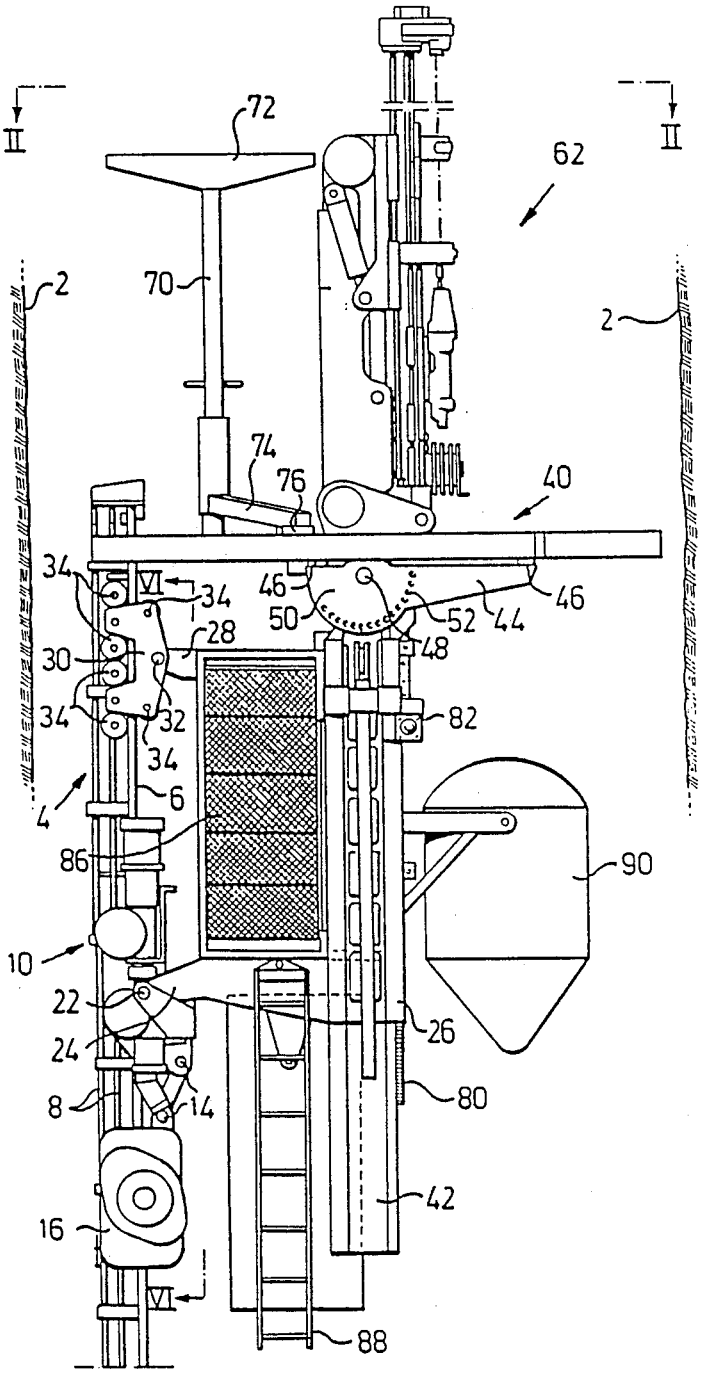

The present invention relates to an arrangement in an assembly for raise mining or the like, said assembly including a drive support carrying a drive means for driving the drive support along a guide carrying the same, said guide being attached to the drift wall and being successively lengthened as drift driving proceeds, said drive support carrying at least one drill rig intended for mechanized drilling, and an operator's and service platform.

When introduced, the now well known raise lift implied a considerable progress within the technique of driving long raises and upwardly inclined tunnels. The work is carried through from a platform, which is carried by and drivable along a guide attached to the drift wall and being successively lengthened concurrently with the drift driving. The platform serves both as a working platform and as transport lift. The work is started from a horizontally extending service drift, to the roof of which the first guide sections are attached, and the driving is thereafter carried through successively upwardly from it, curved guide sections being then provided at the transition. The work is carried through in a number of cycles including the following working steps:

(1) Drilling a number of loading holes upwardly in the top roof of the raise.

(2) Loading these holes.

(3) Blasting. Before blasting the raise lift is driven down for protection in the service drift.

(4) Ventilation. Carbon monoxide, nitrogenous gases and fine dust originating from the blasting, is removed by spraying a mixture of water and air from the top of the guide.

(5) The assembly is driven up to the newly blasted area, where so called scaling is done and a new guide section is mounted.

The above described technique implied considerable improvements from the efficiency and security point of view. The drift driving could thus be done considerably faster than what had been possible earlier, and the working environment and security for the working staff was increased.

Due to the continuously increasing demand for further improved efficiency and working environment further developments of the raise lift have been suggested, i.e. striving towards the introduction of drill boom rigs for mechanised drilling for replacing the manually operated drill machines used hitherto. Besides obvious advantages such as faster drilling and shorter time between the drill holes, the use of such drill rigs implies that the inner ends of the drill holes with great precision can be located in essentially the same plane, which minimizes the required scaling work. Of course, this also contributes to decreasing the physical strain on the working staff. Another working environment improving factor is that the obvious risk for the occurrence of cronical injuries due to transmitted vibrations from the manually operated drill machines is eliminated. Furthermore a greater uniformity with respect to efficiency is secured, since the choice of drill steel length, or of change from a shorter drill steel to a longer one in one and the same drill hole is no longer affected by the will, skill or physical ability of the operator.

Despite the above advantages raise lifts with mechanized drill equipment have been used to a very little extent thus far due to economical and constructive reasons. The drill equipment, being also expensive per se, requires expensive reinforcements of the guides and the frame portions of the raise lift carrying the drill equipment and the operator's platform, a fact that has, thus far, not been possible to be compensated for, by use to the full extent of the inherent advantage of a drill boom rig to be able to work with coarser and longer drill steels. More particularly this has been prevented by the fact that the height dimension of the drill equipment is limited by the necessary minimum distance of the operator's platform from the drift top roof for enabling supplementary works, such as scaling. Attempts thus far to solve this problem have not been successful.

The object of the present invention is to provide an arrangement enabling efficient use to the full extent of all advantages of a mechanized equipment of the drill boom type and admitting use of drill boom rigs able to work with the longest possible drill steels.

This object has been attained in that, according to the invention, in an arrangement of the kind described by way of introduction, the operator's and service platform is shiftable with respect to the drive support along the guide between a lower position, in which it does not obstruct the working movements of the drill boom, and upper positions, in which the drill boom rig in a collapsed inactive position extends through an opening in the operator's platform.

Preferably the drill boom rig is fixedly mounted on the frame and the opening is located essentially centrally in the operator's platform.

According to a suggested embodiment the drive support carries two parallel guide beams for the operator's platform, said beams each guiding a respective parallel support beam, and at the upper end carrying the platform, and drive means being arranged for driving the support beams along the guide beams. The platform can then suitably be pivotally carried about an axis extending between the carrying beams perpendicularly to these.

A protective roof intended for use at scaling and the like, is carried preferably pivotally on a pillar on the platform extending essentially in the direction of the guide, said pillar in its turn being settable about a shaft located essentially centrally on the platform and extending in the direction of the guide, by means of an arm connected to the last mentioned shaft.

The invention and its advantages will appear more closely from the below description with reference to exemplary embodiments shown on the drawings.

On the drawings

Figure 2:
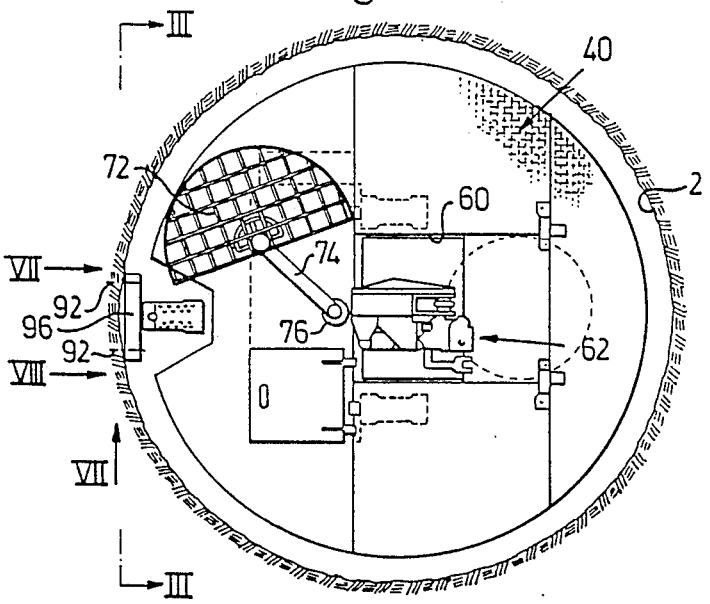
Figure 3:
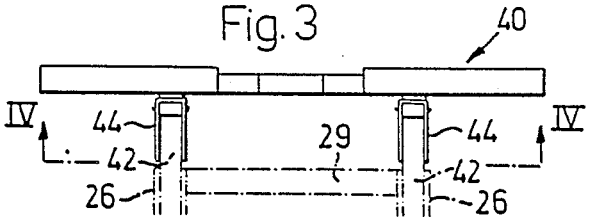
Figure 4:
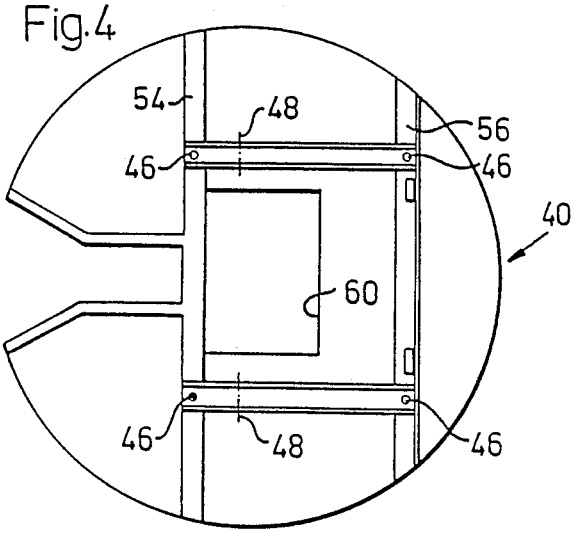
Figure 5:
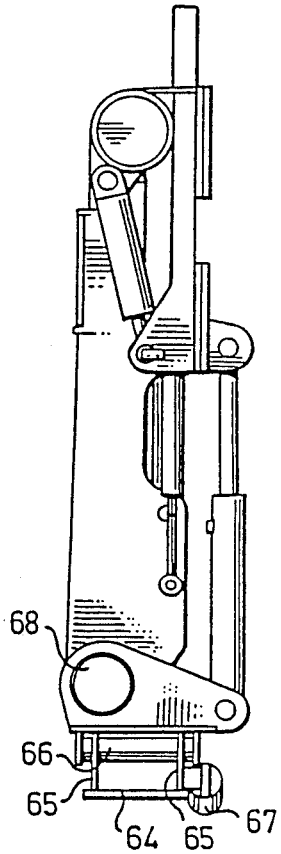
Figure 6:
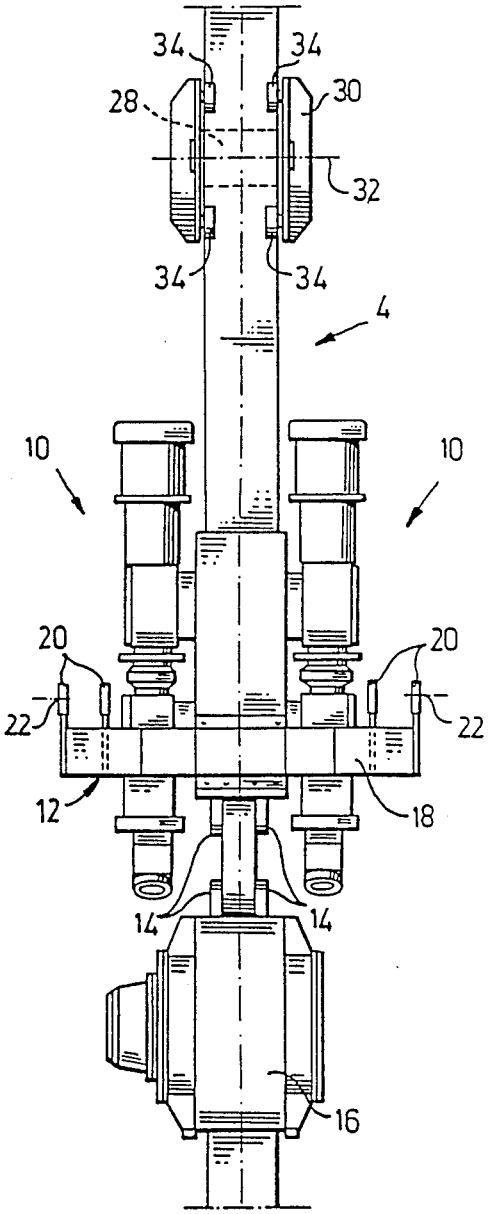
Figure 8:
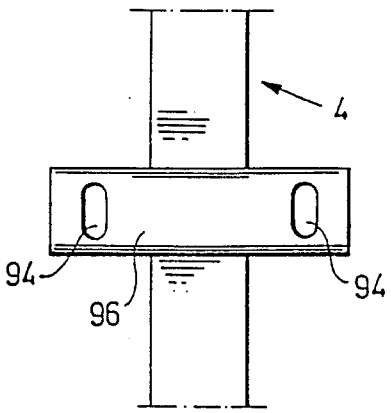
Figure 9:
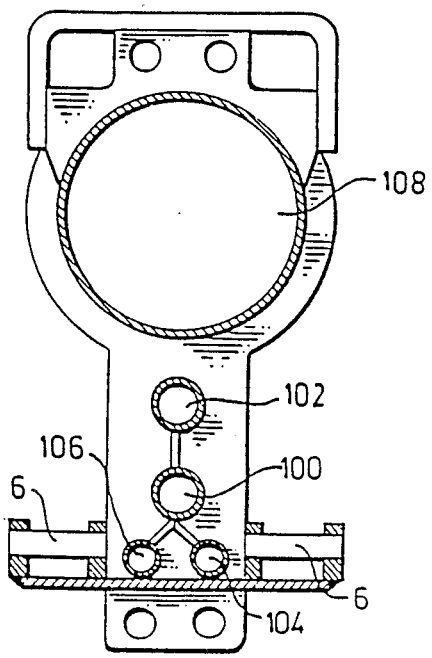

FIG. 1 partly schematically shows a side view of an assembly for raise driving or the like, including an arrangement according to the invention, FIG. 2 shows a plan view of the assembly according to FIG. 1 in the direction of arrows II—II in FIG. 1, FIG. 3 shows a schematic view in the direction of arrows III—III in FIG. 2 of an operator's platform included in the assembly, FIG. 4 shows a schematic view from below in the direction of arrows IV—IV in FIG. 3 of the operator's platform, FIG. 5 shows an enlarged detail side view of the drill boom belonging to the assembly, FIG. 6 shows a schematic plan view in the direction of arrows VI—VI in FIG. 1 of the drive machinery of the assembly, FIGS. 7 and 8 in views in the directions of the arrows VII—VII and VIII—VIII, respectively, in FIG. 1, illustrate a new method for mounting attaching bolts for the guide sections vertically at raise mining, and FIG. 9 schematically, in a tranverse section, shows an embodiment of guide sections, that can be used in connection with the assembly according to the invention.

In FIGS. 1 and 2 the walls of a steep raise or tunnel are designated 2. On a wall, the hanging wall where appropriate, a guide 4 is attached. The guide 4 is composed of a plurality of sections following on each other, and interconnected by means of screw bolt joints not shown. Each guide section is attached, in a way to be described more closely below, by means of anchoring bolts in the rock wall, and each section furthermore rests with its lower end against the upper end of the guide section closest below. Each guide section is composed of a guide element 6 proper in the form of a beam with tooth or pin rack, and tube lines at 8. These tube lines are intended for transport of drive fluids, such as air and water to the equipment. The guide element 6 carries two parallel tooth or pin rack races, one on each side, along its length. With each tooth or pin rack element two drive gears, not shown, are in engagement, each pair of drive gears being included in a drive assembly generally designated 10. The drive assemblies 10 are interconnected by means of a drive support generally designated 12. By means of pivot connections indicated at 14 a catch apparatus 16 is suspended under the drive support 12.

The drive assemblies 10 and catch apparatus 16, as well as the principle design of the guide elements 4,6, can be of a kind conventional at raise lifts or tooth or pin rack carried transport lifts. The drive assemblies 10 can thus e.g. be of the type Alimak STH-5 and the catch apparatus 16 of the type Alimak GA-5.

The drive support 12 includes a transverse beam 18, which at each end carries a pair of pivot supports 20. The pivot supports 20 of each pair carry pivotally, at 22, between them a protruding frame beam 24. At their ends remote from the pivot supports 20 the beams 24 are interconnected by means of a transverse beam, not shown, and carry each an upwardly directed guide beam 26, to be disclosed more in detail below. At their upper ends the guide beams are interconnected by means of a transverse beam indicated at 29 in FIG. 3. From the middle of the transverse beam a frame beam 28 extends inwardly towards a roller support 30 movable on the guide. More particularly, the frame beam 28 and the roller support 30 are interconnected at a transverse pivot 32, the direction of which is the same as that of the pivots 20. Rollers, running freely on the guide, of the roller support 30 are indicated at 34. By means of the pivots 20 and 32 the drive support 12 and roller support 30 can be angled with respect to each other and with respect to the frame support including elements 24, 26 and 28, when running in curves extending in the plane of the drawing FIG. 1.

An operator's and service platform generally designated 40 is carried at the upper end of a pair of support beams 42, which are telescopically guided in each a respective guide beam 26. More particularly the platform 40 is carried on a pair of longitudinal U-beam brackets 44 via end bolt connections 46. These bolt connections inlcude devibrated rubber elements, not shown, which can be designed in a conventional way and are intended to eliminate transmission of vibrations to the platform 40 from the rest of the equipment. Each one of the brackets 44 bridges the upper end of the corresponding support beam 42 and is carried thereon by means of a pivot shaft 48. The pivot shaft 48 forms the centre of a circular segment shaped extension 50 of the bracket 44. Along the periphery of this circular segment 50 a row of holes 52 is located. The platform 40 is settable about the pivot shafts 48 for securing horizontal position of the platform independently of the inclination of the raise. The platform 40 is locked in a set position by means of a lock pin, not shown, extending through a hole 50 and a corresponding hole in the support beam 42.

FIG. 4 schematically illustrates how the platform 40 is provided on the brackets 44 via a framework, of which two transverse beams 54 and 56 are shown.

The platform 40 contains a central rectangular opening 60, through which a drill boom rig, generally designated 62, is mounted on the transverse beam 29 in a way not shown by means of a foot plate 64 visible in FIG. 5. On the footplate 64 the drill boom rig is carried via upstanding pivot supports 65 on a pivot shaft 66, which allows swinging of the drill boom perpendicularly with respect to the plane of FIG. 1, besides the swinging movement perpendicular thereto, which is allowed about the shaft 66. At 67 a hydraulic cylinder is indicated, which acts between one of the pivot supports 65 and a lever, not shown, connected to the pivot shaft 66. The details of the drill boom just described can, as well as the drill boom for the rest, be of a kind conventional to the man of the art and need therefore not be described here more closely. Although not shown on the drawings the drill boom rig can preferably be of such a type, per se known, where boom and feader are telescopically extendable for allowing drilling with the longest possible drill steels.

A pillar 70, resting with its lower end on the platform 40, at its upper end pivotally carries a circular segment shaped, e.g. half circle shaped protection grid roof 72 intended to be used at scaling works and the like. In the vicinity of its lower end the pillar 70 via an arm 74 is connected to a pivot shaft 76 in the platform 40, parallel with the pillar 70. The size of the protection grid 72 is such that by means of its mobility allowed by the pivots, it can be swung sidewardly to leave space for work with the drill rig 62.

For driving the support beams 42 and thereby the platform 40 upwardly in the guides 26 suitable drive means are arranged. In the embodiment shown in pin rack carried by the beam 42 is indicated at 80, and at 82 a drive motor carried by the guide beam 26, said drive motor driving tooth wheels, not shown, being in engagement with the pin rack 80. It can, however, also be suitable to use instead, for the same purpose, a hydraulic cylinder that acts between the guide beams 26 and the platform 40, e.g. between a transverse beam interconnecting the guide beams, e.g. the beam 29, and the platform 40 with a point of engagement on the latter e.g. at the frame beam 54 (FIG. 4).

At 86 a lift cage carried by the guide beams 26 is shown, which in a conventional way is used for passenger transport at driving of the equipment to and from the working site. A ladder 88 leads to the lift cage 86.

In the embodiment shown the guide beams 26 further carry a container 90 for so called "ANFO"-blasting agent, which is essentially pulverous and via a hose, not shown, is conveyed to the drill holes for being sprayed into these. Of course, the use of other blasting agents is, however, conceivable.

Initiation of the blasting agent can be carried through by means of a device of the kind described in the U.S. Pat. No. 4,037,537. The pressurized air operated blasting apparatus described therein can then in a very advantageous way be constructively included in the top protection unit thereof, that protects the upper end of the uppermost guide section and includes outlets for spraying a water curtain in connection with ventilation of the shaft after blasting. Pressurized air to the blasting apparatus thus provided is fed via a separate pressurized air conduct, not shown, in the guide. This arrangement as well as the blasting apparatus in question, are described in detail in said patent specification and need therefore not be disclosed more closely here.

As was mentioned above by way of introduction, the operating cycle of the conventional raise lift includes that before blasting it is driven into safety in a service shaft, whereupon it after ventilation of the raise is driven upwardly to its upper end for finishing works. The same process is carried through by means of the above described equipment according to the invention, whereby, however, after the raise end has been reached, the platform 40 is elevated with respect to the rest of the assembly by starting the drive means 80, 82 acting between the platform 40 and the guide means 26 so that the platform comes to a comfortable height from the raise roof. The drill assembly 62, being then collapsed in "parking position", is then located with a lower part under the level of the platform 40, and extends through the opening 60 therein. During the progress of the scaling work the protective roof 72 is moved to desired positions by the mobility around the pivot 76 and the pillar 70.

One or more new guide sections are thereafter installed with the platform 40 brought to a suitable level for each working step then incurred. After conclusion of these operations the platform 40 is driven down to its lowest level with respect to the rest of the assembly so that the drill boom rig 62 can start a new drilling cycle.

For attaching the guide sections anchoring bolts are used which are introduced into the shaft wall conventionally perpendicularly from the guide. At driving of long shafts and with comparatively heavy equipment suspended on the guide, the load on the lower anchoring bolt ends located at the guide, can be so great that the anchoring bolts are bent, with the result that the guide obtains a curve shaped course at its lower sections. In an attempt to eliminate this, guide sections with closer mounted anchoring bolts have been introduced with uniform spaces.

Figure 7:
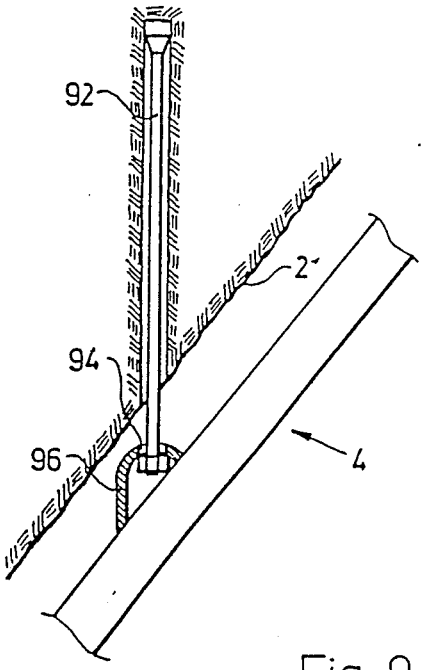

In the present case it is, while referring to FIGS. 7 and 8, proposed that the anchoring bolts shall be directed upwardly under an angle with respect to the guide, in order to eliminate the bending stresses acting thereupon to the greatest possible extent. In inclined shafts the anchoring bolts are preferably vertically mounted. For this purpose attachment means for the anchoring bolt 92, on the guide, are provided with a longitudinal hole 94 extending in the direction of the guide, through which the anchoring bolt 92 extends and is angularly settable with respect to the guide. The oblong hole is located in an arcuately bent mounting iron 96 attached to the guide, to which the anchoring bolt is attached by means of a lock nut connection 98. The curvature of the support iron is chosen so that, for each attachment position of the bolt, it extends essentially perpendicularly to the anchoring bolt.

The ventilation after blasting, described above, can conventionally be carried through by means of so called pressurized ventilation, implying that the blasting gases are removed during a ventilation time, which can extend approximately 1–3 hours, by spraying water and air out through the upper end of the guide. The water binds the particles in the blasting gases, and by means of the overpressure caused by the air injection, the blasting gases and the particles included therein are vented down through the shaft.

For shortening the ventilation time it is, however, in the present case suggested to use guide sections with essentially the transverse section shown in FIG. 9. In FIG. 9 the parallel pin rack races have been designated 6 as earlier. The guide section is furthermore illustrated with channels 100 and 102 for water and pressurized air, respectively, for the drill machine. Furthermore, the earlier described pressurized air conduit for a pressurized air operated blasting apparatus according to the U.S. Pat. No. 4,037,537 is here designated 104. Along this conduit a reserve conduit 106 extends.

Particularly characteristic for the guide section shown in FIG. 9 is a coarse ventilation conduit 108, which is intended to be connected to a fan installation.

Via the tube 108 suction ventilation is carried through by sucking out, directly after blasting, the blasting gases when the concentration is highest at the upper end of the shaft. At the final phase of the ventilation step air and water in the same way as earlier is blowed in, in order to make the environment at the top as good as possible before the next working cycle is started.

Two factors acting against each other can effect the choice of dimension of the tube conduit 108. The ventilation time becomes shorter the coarser the tube is. An upper limit for the size of the tube 108 is, however, determined by the desire that the guide section must not be too heavy and unwieldy.

In the present case a tube with an inner diameter of an order of magnitude of approximately 18 cm is preferred.

With this new ventilation method the ventilation time can be considerably decreased and more particularly to about a half or third of that earlier required for only pressure ventilation.

In the above described assembly the operator of the drill equipment can furthermore, according to a particularly advantageous embodiment, during the drilling step be located in the lift cage 86, which can then suitably also be made of a sound isolating material and devibrated. For allowing the operator to control the work a television camera is mounted on a suitable position on the platform, with the monitor(s) belonging thereto mounted in the cage and on the drift bottom, respectively.

The assembly can also include equipment known per se for controlling the parallelity of the drill holes. In such an equipment e.g. two sensors are located on the drill boom, more particularly one down at the attachment to the pivot means and the other where the feeder is attached. Starting from the inclination of the guide as a basis, one instrument indicates when the drill steel extends in parallel with the guide. By means of such a device it is easy to set a desired look-out angle.

I claim:

1. An arrangement in an assembly for raise driving, said assembly including:

a drive support for carrying at least one drill boom rig intended for mechanized drilling and movable to a collapsed disabled position;

a guide attached to a drift wall and being successively lengthened as drift driving proceeds;

a drive means carried by said drive support for driving said drive support along said guide;

an operator's and service platform having an opening; and means for carrying said platform so as to be movable with respect to the drive support in the direction of the guide from a lower position with respect to the drive support in which the platform does not obstruct operating movements of the drill boom rig, to upper positions with respect to the drive support in which the drill boom rig assumes said collapsed disabled position and extends through said opening in said platform.

2. An arrangement according to claim 1 wherein the drill boom rig is fixedly mounted on the drive support centrally with respect to the platform, and that the opening is located essentially centrally in the platform.

3. An arrangement according to claim 1, further comprising guide beam means carried by said drive support, support beam means guided upon said guide beam means and drive means for driving said support beam means along said guide beam means.

4. An arrangement according to claim 3, wherein the platform is carried pivotally about an axis extending perpendicularly to the guide beams.

5. An arrangement according to claim 3, wherein the drill boom rig is carried by the guide beams near their upper ends.

6. An arrangement according to claim 1 further comprising a protection roof pivotally carried on a pillar on the platform extending essentially in the direction of the guide, said pillar being settable about a pivot shaft located near the opening and extending essentially in the direction of the guide, by means of an arm connected to said pivot shaft.

7. An arrangement according to claim 1, wherein the guide carries two parallel tooth or pin rack races and that the drive means includes two drive assemblies for cooperation with a respective one of said races.

8. An arrangement according to claim 1 wherein the drive support also carries a catch apparatus intended for cooperation with the guide.

9. An arrangement according to claim 1 further comprising a drive means for the movement of the platform including a tooth or pin rack drive.

10. An arrangement according to claim 1 further comprising a drive means for the movement of the platform including a hydraulic cylinder.

11. An arrangement according to claim 1 further comprising anchoring bolts for the guide angled upwardly with respect to the guide.

12. An arrangement according to claim 11 wherein said anchoring bolts extend vertically.

13. An arrangement in an assembly for raise mining, said assembly including a drive support carrying a drive means for driving the drive support along a guide, the guide being attached to a drift wall and successively lengthened as drift driving proceeds, said drive support carrying at least one drill boom rig intended for mechanized drilling, an operator's and service platform, and means allowing suction ventilation of the shaft after blasting.

14. An arrangement according to claim 12, wherein the guide comprises guide sections containing a channel dimensioned for suction ventilation.

15. An arrangement according to claim 12, further comprising means for allowing pressurized ventilation after the suction ventilation.

* * * * *